US008143979B2

(12) United States Patent
Usami et al.

(10) Patent No.: US 8,143,979 B2
(45) Date of Patent: Mar. 27, 2012

(54) ELECTROMAGNETIC RELAY FOR STARTERS

(75) Inventors: Shinji Usami, Okazaki (JP); Masami Niimi, Handa (JP); Mitsuhiro Murata, Niwa-gun (JP); Mikio Saitoh, Mizuho (JP)

(73) Assignee: Denso Corporation, Kariya (JP)

( * ) Notice: Subject to any disclaimer, the term of this patent is extended or adjusted under 35 U.S.C. 154(b) by 131 days.

(21) Appl. No.: 12/823,478

(22) Filed: Jun. 25, 2010

(65) Prior Publication Data

US 2011/0001589 A1 Jan. 6, 2011

(30) Foreign Application Priority Data

Jul. 1, 2009 (JP) ..... 2009-156752
Dec. 14, 2009 (JP) ..... 2009-282891

(51) Int. Cl.
*H01H 63/02* (2006.01)

(52) U.S. Cl. ..... 335/131; 335/127; 335/132; 335/133; 335/196

(58) Field of Classification Search ..... 335/126, 335/127, 131–133, 196–200; 290/38 R–38 E, 290/48; 200/275–279
See application file for complete search history.

(56) References Cited

U.S. PATENT DOCUMENTS 5,424,700 A 6/1995 Santarelli
2009/0183595 A1 7/2009 Niimi

FOREIGN PATENT DOCUMENTS

DE 4224999 A1 * 2/1994
JP 05325758 A * 12/1993
JP A-2009-191843 8/2009

* cited by examiner

*Primary Examiner* — Ramon Barrera
(74) *Attorney, Agent, or Firm* — Oliff & Berridge, PLC

(57) ABSTRACT

Terminal-bolts and a fixed contact are formed with different kinds of metals, and fixed to a fixing hole formed in the fixed contact by press fitting one end of the terminal-bolts. A plurality of concavo-convex parts is provided on a surface of the fixed contact that faces the movable contact. A plurality of concavo-convex portions is provided on another surface of the fixed contact that faces an anti movable-contact side. The concavo-convex portions are arranged so that positions of concave parts of the concavo-convex portions match positions of convex parts of the concavo-convex portions provided in the opposite surface of the fixed contact. The concavo-convex parts are at least partly curved, and have the same height and project in a height direction from the fixed contact.

6 Claims, 8 Drawing Sheets

ELECTROMAGNETIC RELAY FOR STARTERS

CROSS-REFERENCE TO RELATED APPLICATION

This application is based on and claims the benefit of priority from earlier Japanese Patent Applications No. 2009-156752 filed on Jul. 1, 2009, and No. 2009-282891 filed on Dec. 14, 2009, the descriptions of which are incorporated herein by reference.

BACKGROUND OF THE INVENTION

1. Technical Field of the Invention

The present invention relates to an electromagnetic relay for starters that opens and closes an electric point-of-contact using the attractive force of an electromagnet.

2. Description of the Related Art

Conventionally, an electromagnetic switch for starters using an electromagnetic relay is known as disclosed in U.S. Pat. No. 5,424,700, for example The electromagnetic switch disclosed in U.S. Pat. No. 5,424,700 has an operation that opens and closes the main point-of-contact provided in a motor circuit of a starter.

This electromagnetic switch has a B terminal-bolt that is connected to a power supply side of a motor circuit, an M terminal-bolt connected to a load side (motor side) of the motor circuit, a set of fixed contacts provided in each end of the terminal-bolts, and a movable contact that electrically intermits the set of fixed contacts.

In the fixed contact, a plurality of projection parts are provided in the point-of-contact side that faces the movable contact, when the set of fixed contacts is connected together, and the projection parts of the fixed contacts contact the movable contact, a main point-of-contact will be in a closed state, and electric power will be supplied to the motor from a battery.

However, in order to provided a plurality of projection parts in the point-of-contact side of the fixed contact as shown in U.S. Pat. No. 5,424,700, forging must be performed, thus a large-scale cold forge machine is needed, which becomes a factor in which product cost rises.

When forming the terminal-bolts and the fixed contact with different kinds of metals, welding etc is required to join the both; there will be a problem that number of manufacturing process may increase sharply.

SUMMARY OF THE INVENTION

The present invention has been made in order to solve the issues described above, and has as its object to provide an electromagnetic relay that is not necessary to use a large-scale production facility in order to provide a plurality of projection parts on a surface of a fixed contact that faces a movable contact, and enables a simplification of the manufacturing process.

In an electromagnetic relay for starters according to a first aspect, the electromagnetic relay for starters has a first terminal-bolt that is connected to a power supply side of an electric circuit, a second terminal-bolt connected to a load side of the electric circuit, a set of fixed contacts fixed on each one end of the first and second terminal-bolts, a movable contact that faces and is movable to the set of fixed contacts, and a solenoid that drives a movable core by forming an electromagnet by energization.

The movable contact that synchronizes movement of the movable core electrically intermits the set of fixed contacts, and the first and second terminal-bolts and the set of fixed contacts are formed with different kinds of metals, and fixed mechanically.

A plurality of concavo-convex parts is provided on a surface of the fixed contact that faces the movable contact, and a plurality of concavo-convex portions is provided on another surface of the fixed contact that faces an anti movable-contact side.

The concavo-convex portions are arranged so that positions of concave parts of the concavo-convex portions match positions of convex parts of the concavo-convex portions provided in the opposite surface of the fixed contact.

The plurality of concavo-convex parts are at least partly curved, and have the same height and project in a height direction from the fixed contact.

According to the above-mentioned composition, since the first and second terminal-bolts and the fixed contact are assembled and fixed mechanically, joining processes, such as welding, are unnecessary. Thereby, the manufacturing process can be greatly simplified.

Because the plurality of concavo-convex parts provided in one surface of the fixed contact are at least partly curved, and have the same height, and project in a height direction from the fixed contact, loose connection of the movable contact and the fixed contacts can be prevented, since the tips of the concavo-convex parts can contact the surface of the movable contact when the movable contact contacts the fixed contact.

In an electromagnetic relay for starters according to a second aspect, wherein, when a direction that is perpendicular to the axial direction of the first and second terminal-bolts is called the direction-between-point-of-contact, and when a direction that intersects the direction of plate thickness of the fixed contact and intersects perpendicularly with the direction-between-point-of-contact is called a point-of-contact-width-direction, the concavo-convex parts and the concavo-convex portions are formed in predetermined length from the end surface of the fixed contact along the direction-between-point-of-contact, and the concavo-convex parts and the concavo-convex portions are formed in parallel with a fixed interval therebetween in the point-of-contact-width-direction.

In an electromagnetic relay for starters according to a third aspect, wherein, the concavo-convex parts and the concavo-convex portions are formed by pressing.

In an electromagnetic relay for starters according to a fourth aspect, a fixing hole is formed on to the fixed contact that penetrates in a direction of plate thickness, and each one end of the first and second terminal-bolts is pressed fit into the fixing hole.

In an electromagnetic relay for starters according to a fifth aspect, serrations are formed in the perimeter sides of the one ends of the first and second terminal-bolts, and the first and second terminal-bolts are serration press fit to the fixing holes formed in the fixed contacts.

In an electromagnetic relay for starters according to a sixth aspect, the electromagnetic relay is used for a switch for motor energization that switches on/off a current that flows from battery to a starter motor for starting engines.

DETAILED DESCRIPTION OF THE PREFERRED EMBODIMENTS

An embodiment of an electromagnetic relay to which the present invention is applied will be described in detail with reference to the attached drawings.

[First Embodiment]

In this first embodiment, an example of an electromagnetic relay applied to a switch for motor energization equipped in a starter is explained.

Figure 2:
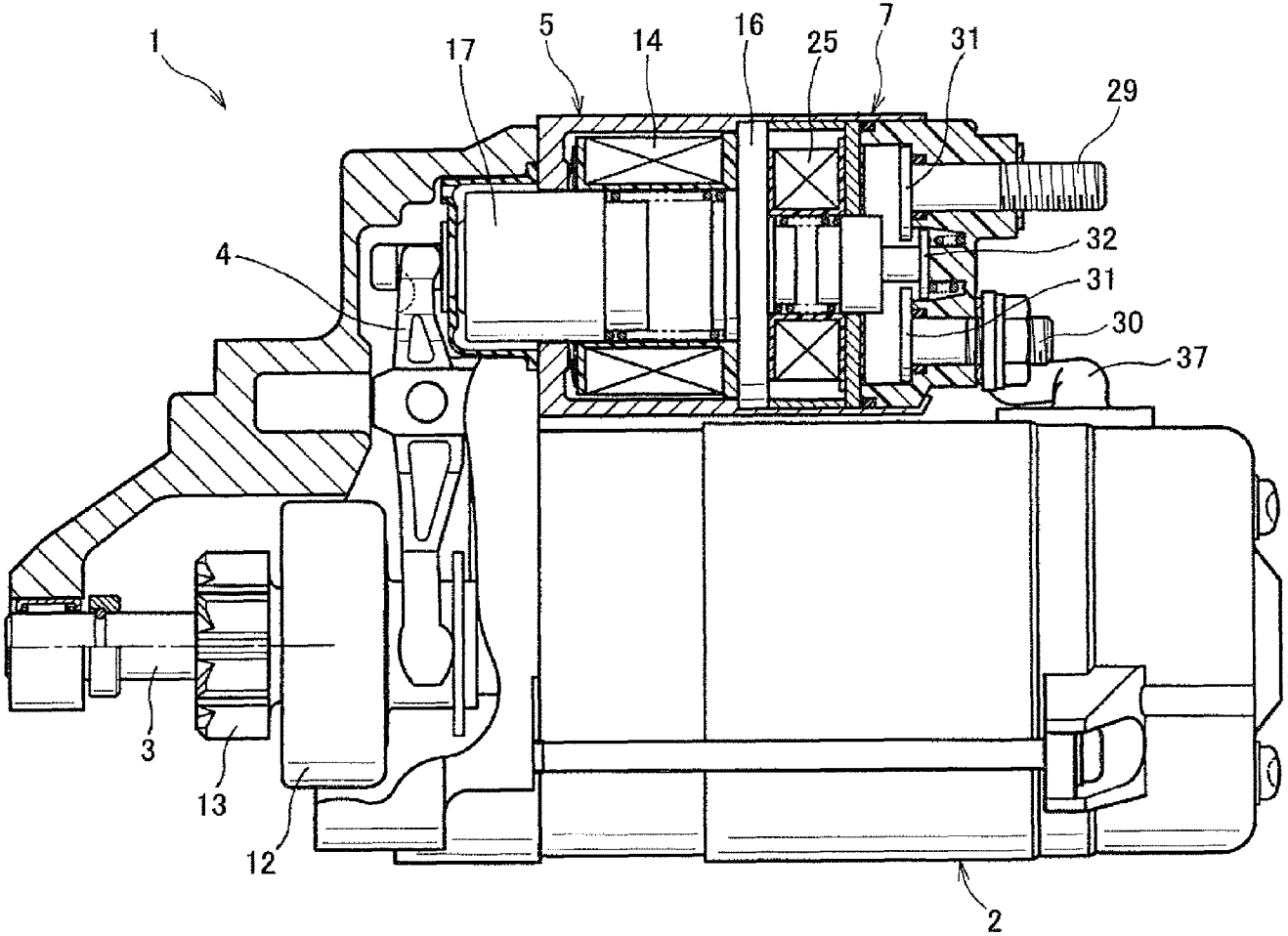
FIG. 2 shows a sectional view of a starter.

As shown in FIG. 2, the starter 1 has a motor 2, an output shaft 3, a pinion movable body (mentioned later), shift lever 4, a solenoid 5 for pushing out a pinion, a battery 6 (refer to FIG. 6), and a switch 7 for motor energization.

The motor 2 generates torque, and this torque is transmitted to the output shaft 3 to make it rotate. The pinion movable body is movably provided in an axial direction on a perimeter of the output shaft 3. The solenoid 5 pushes out the pinion movable body in an anti-motor direction (to the left of FIG. 2) via the shift lever 4. The switch 7 opens and closes a motor point-of-contact (explained later) provided in a motor circuit for passing current to the motor 2 from the battery 6 (referring to FIG. 6).

Figure 6:
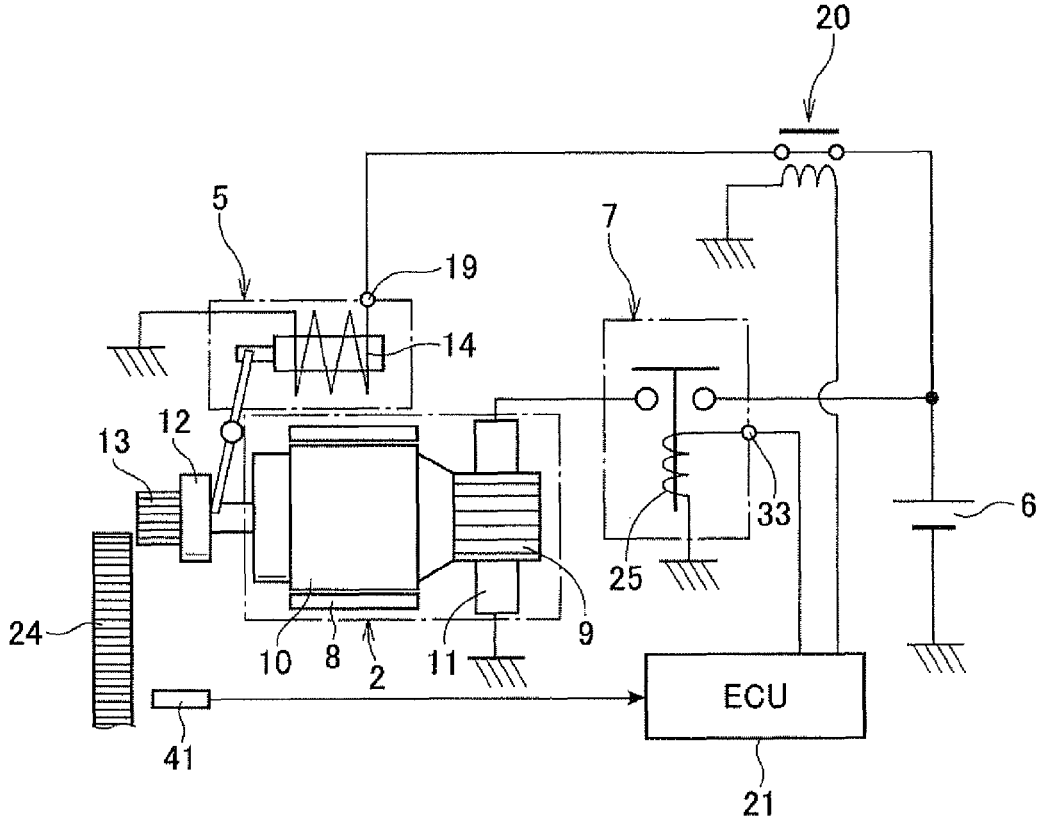
FIG. 6 shows an electric circuit of the starter.

As shown in FIG. 6, the motor 2 is a commutator motor provided with a magnetic field 8 constituted by arranging a plurality of permanent magnets in an inner circumference of a yoke 9, an armature 10 provided with a commutator 11 on an end of an armature shaft, and brushes 13 arranged contacting with a perimeter of the commutator 11 (called a commutator side) and being pressed to the commutator side by brush springs 12, for example.

The electromagnet field generated by a field coil can also be used for the magnetic field 8 of the motor 2 instead of the permanent magnets.

The output shaft 3 is arranged coaxially with the armature shaft via reduction gears (not shown), and a speed of the motor 2 is slowed down by the reduction gears, and then transmitted.

The reduction gears are commonly known planetary reduction gears, for example, and a planet carrier that receives the orbital motion of a planetary gear is provided integrally with the output shaft 3.

The pinion movable body is composed of a clutch 12 and a pinion 13.

The clutch 12 is a commonly known one-way clutch and is constitute of an outer clutch that fits the perimeter of the output shaft 3 in a helical spline manner, an inner clutch arranged to rotate freely relative to the inner circumference of the outer clutch, and rollers that intermit the torque transfer between the outer clutch and the inner clutch.

The clutch 12 transmits torque only one way from the outer clutch to the inner clutch via the rollers, The pinion 13 is formed integrally with the inner clutch, and is supported relatively rotation free by the perimeter of the output shaft 3 via a bearing (not shown).

Figure 1:
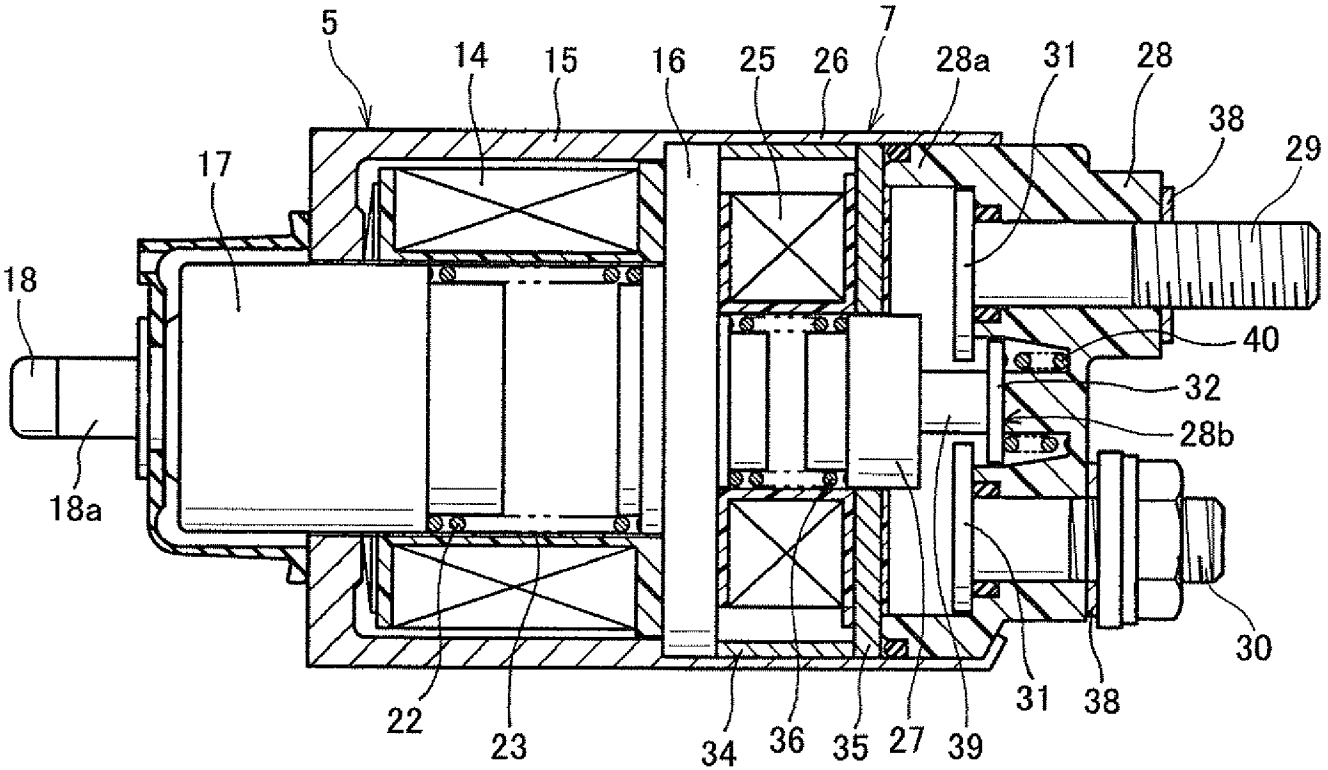
FIG. 1 shows a sectional view of a solenoid for pinion extrusion and a switch for motor energization according to a first embodiment.

As shown in FIG. 1, the solenoid 5 is constituted of the solenoid coil 14, a solenoid yoke 15, a fixed iron core 16, a plunger 17, a joint 18 and the like.

The solenoid coil 14 generates a magnetic field by energization. The solenoid yoke 15 forms a magnetic path in the perimeter of the solenoid coil 14. The plunger 17 that faces an receiving side formed on an end in the axial direction (left side in the figure) of the fixed iron core 16 moves on the inner circumference of the solenoid coil 14 in the axial direction. The joint 18 transmits motion of the plunger 17 to the shift lever 4.

One end of the solenoid coil 14 is connected to a connector terminal 19 (refer to FIG. 6), and the opposite end of the solenoid coil 14 is grounded by, for example, welding or etc. to the surface of the fixed iron core 16.

An electric wiring that leads to a starter relay 20 is connected to the connector terminal 19.

The starter relay 20 is controlled on/off by an Electrical Control Unit, or ECU 21 (refer to FIG. 6), and when the starter relay 20 is controlled to be on, the solenoid coil 14 is energized from the battery 6 through the starter relay 20.

When the fixed iron core 16 is magnetized by the energization to the solenoid coil 14, attractive force occurs between the plunger 17 and the fixed iron core 16. The plunger 17 is then attracted to the receiving side of the fixed iron core 16 resisting a counterforce of a return spring 22, which is arranged between the plunger 17 and the fixed iron core 16.

When the energization to the solenoid coil 14 is stopped and attractive force disappears, the plunger 17 is pushed back in a direction away from the iron core (to the left in FIG. 1) by the counterforce of the return spring 22.

This plunger 17 is formed in a cylindrical shape having a cylindrical hole in its central part in a radial direction. The cylindrical hole opens to an end side in an axial direction of the plunger 17, and has a bottom in the opposite end side.

A metal sleeve 23 that guides the movement of the plunger 17 is arranged in the inner circumference of the solenoid coil 14.

The joint 18 is inserted into the cylindrical hole of the plunger 17 with a drive spring (not shown).

The joint 18 is formed cylindrically. An engagement slot 18*a* with which one end of the shift lever 4 engages is formed on an end side of an end portion that projects from the cylindrical hole of the plunger 17, and a flange part is provided on an end side of the opposite end portion.

The flange part has an outer diameter that can slide on the inner circumference of the cylindrical hole, and is forced against the bottom of the cylindrical hole in response to the load of the drive spring.

After the end surface of the pinion 13 pushed out by the movement of the plunger 17 in the direction of an anti-motor side via the shift lever 4 contacts an end surface of a ring gear 24 (refer to FIG. 6) that rotates integrally with an engine crankshaft, the drive spring is compressed, while the plunger 17 moves until it is received in the fixed iron core 16, and conserves the counterforce for making the ring gear 24 mesh with the pinion 13.

As shown in FIG. 1, the switch 7 for motor energization is constituted of a switch coil 25, a switch yoke 26, a movable core 27, a resin cover 28, two terminal-bolts 29 and 30, a set of fixed contacts 31, a movable contact 32, and the like.

The switch coil 25 generates a magnetic field by energization. The switch yoke 26 forms a magnetic path in the perimeter of the switch coil 25. The movable core 27 that faces a receiving side formed on an end in the axial direction of the fixed iron core 16 moves on the switch coil 25 in the axial direction.

The resin cover 28 closes an opening of the switch yoke 26 and attached thereto. The two terminal-bolts 29 and 30 are fixed to the resin cover 28. The set of the fixed contacts 31 are electrically connected to the two terminal-bolts 29 and 30. The movable contact 32 intermittently bridges the set of the fixed contacts 31.

The switch yoke 26 is formed continuously in the axial direction from the solenoid yoke 15, and the solenoid yoke 15 and switch yoke 26 are provided integrally as a whole yoke.

As shown in FIG. 1, the whole yoke has a bottomed pipe form with an annular bottom in one end in the axial direction (left side in the figure) and an opening in an opposite end. The whole yoke has the same size of an outer diameter from one end to the opposite end in the axial direction.

An inner diameter of the opposite end in the axial direction that forms the switch yoke 26 is larger than the one end in the axial direction that forms the solenoid yoke 15, while the thickness of the opposite end is made thinner than the one end, thus forming a level difference between both ends.

The fixed iron core 16 is inserted into the inside of the whole yoke from the opening end of the switch yoke 26 that opens in the opposite end of the whole yoke.

The end surface of a perimeter part in the one end in the axial direction of the fixed iron core 16 contacts the above-mentioned level difference, so that the fixed iron core 16 is positioned at the solenoid coil 14 side in the axial direction.

One end of the switch coil 25 is connected to an external terminal 33 (refer to FIG. 6), and the opposite end of the switch coil 25 is grounded by, for example, welding or etc. to the surface of the fixed iron core 16.

The external terminal 33 is formed projecting outside from an end surface of the resin cover 28, and is connected an electric wiring to the ECU 21.

An axial direction magnetic member 34 and a radial direction magnetic member 35 that form parts of a magnetic path are arranged on a perimeter side in the radial direction of the switch coil 25 and on an anti-fixed iron core side in the axial direction of the switch coil 25, respectively.

The axial direction magnetic member 34 has a cylindrical shape, and inserted into the inner circumference of the switch yoke 26 with almost no crevice. The end surface of one end side in the axial direction of the axial direction magnetic member 34 contacts with the perimeter surface of the fixed iron core 16, and is positioned in the axial direction.

The radial direction magnetic member 35 is arranged perpendicular to the axial direction of the switch coil 25. The coil side position of the radial direction magnetic member 35 is restrained from moving by contacting a perimeter end surface of one end side in the axial direction to an end in the axial direction of the axial direction magnetic member 34.

The radial direction magnetic member 35 has a round hole opened in the radial center so that the movable core 27 can move in the axial direction When the fixed iron core 16 is magnetized by the energization to the switch coil 25, attractive force occurs between the movable core 27 and the fixed iron core 16. The movable core 27 is then attracted to the receiving side of the fixed iron core 16 resisting a counterforce of a return spring 36, which is arranged between the movable core 27 and the fixed iron core 16.

When the energization to the switch coil 25 is stopped and attractive force disappears, the movable core 27 is pushed back in a direction away from the iron core (to the right in FIG. 1) by the counterforce of the return spring 36.

The resin cover 28 has a cylindrical leg 28*a*. The leg 28*a* is inserted in the inner circumference of the switch yoke 26. The leg 28*a* is arranged so that the end surface of the leg 28*a* contacts the surface of the radial direction magnetic member 35, and fixed to the opening end of the switch yoke 26 by crimping.

Two terminal-bolts 29 and 30 are a B terminal-bolt 29 to which the battery cable is connected, and an M terminal-bolt 30 to which the motor lead 37 (refer to FIG. 2) is connected. Two terminal-bolts 29 and 30 penetrate the bottom of the resin cover 28, and are attached thereto, while each of the bolts are fixed to the resin cover 28 by crimping washers 38.

The set of fixed contacts 31 are formed separately to the two terminal-bolts 29 and 30. The fixed contacts 31 have a flat plate shape, and are mechanically fixed to the ends of the two terminal-bolts 29 and 30 that enter inside the resin cover 28.

Figure 3:
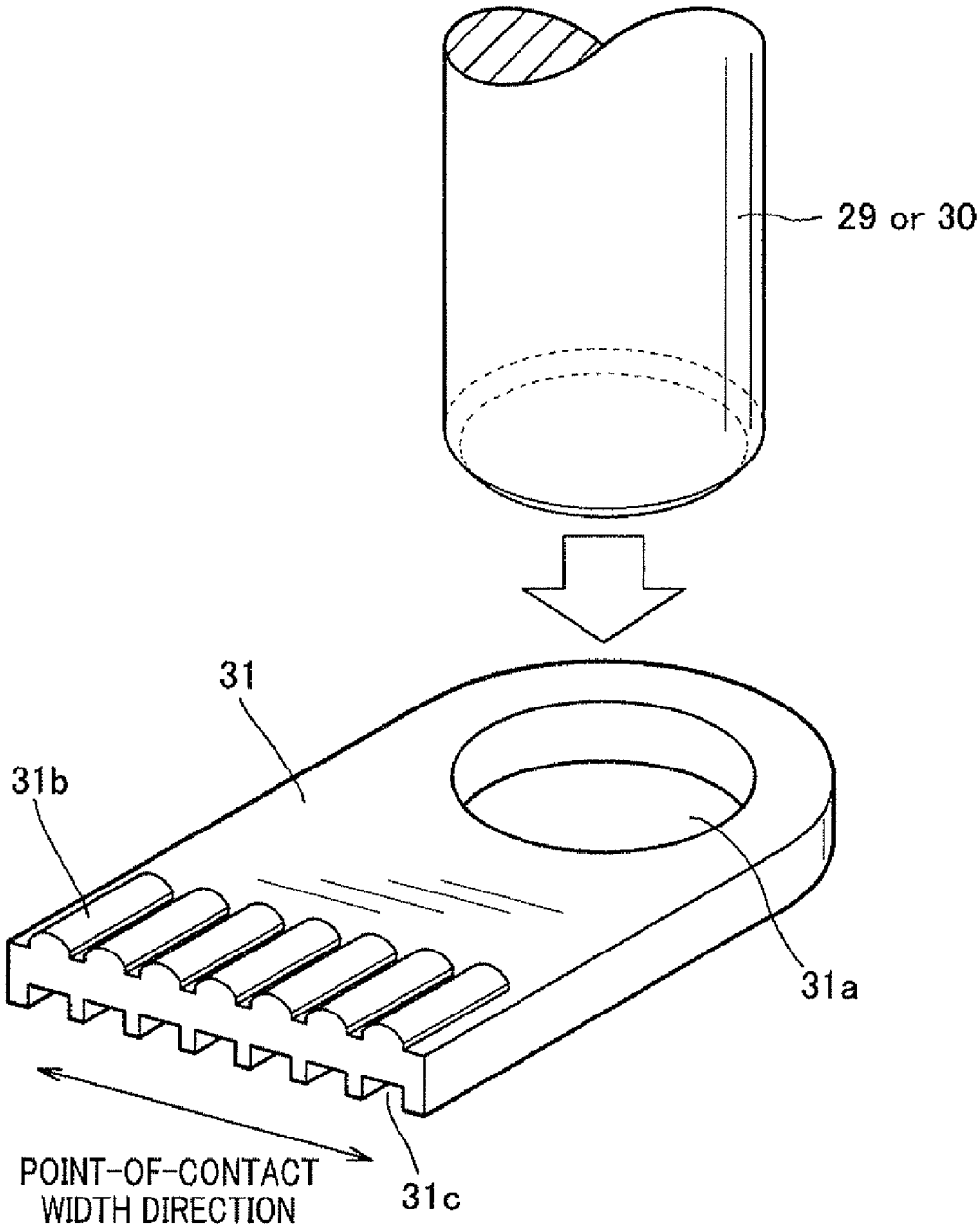
FIG. 3 shows a perspective view showing an assembling process of a terminal-bolt and a fixed contact.

Specifically, as shown in FIG. 3, a circular fixing hole 31*a* is formed on to the fixed contact 31 by penetrating the plate in the direction of plate thickness (vertical direction in the figure). The one end of the terminal-bolt 29 (and 30) is pressed fit into the fixing hole 31*a* from above of the figure, and the fixed contact 31 is fixed to the one end of the terminal-bolt 29 (and 30).

Figure 4:
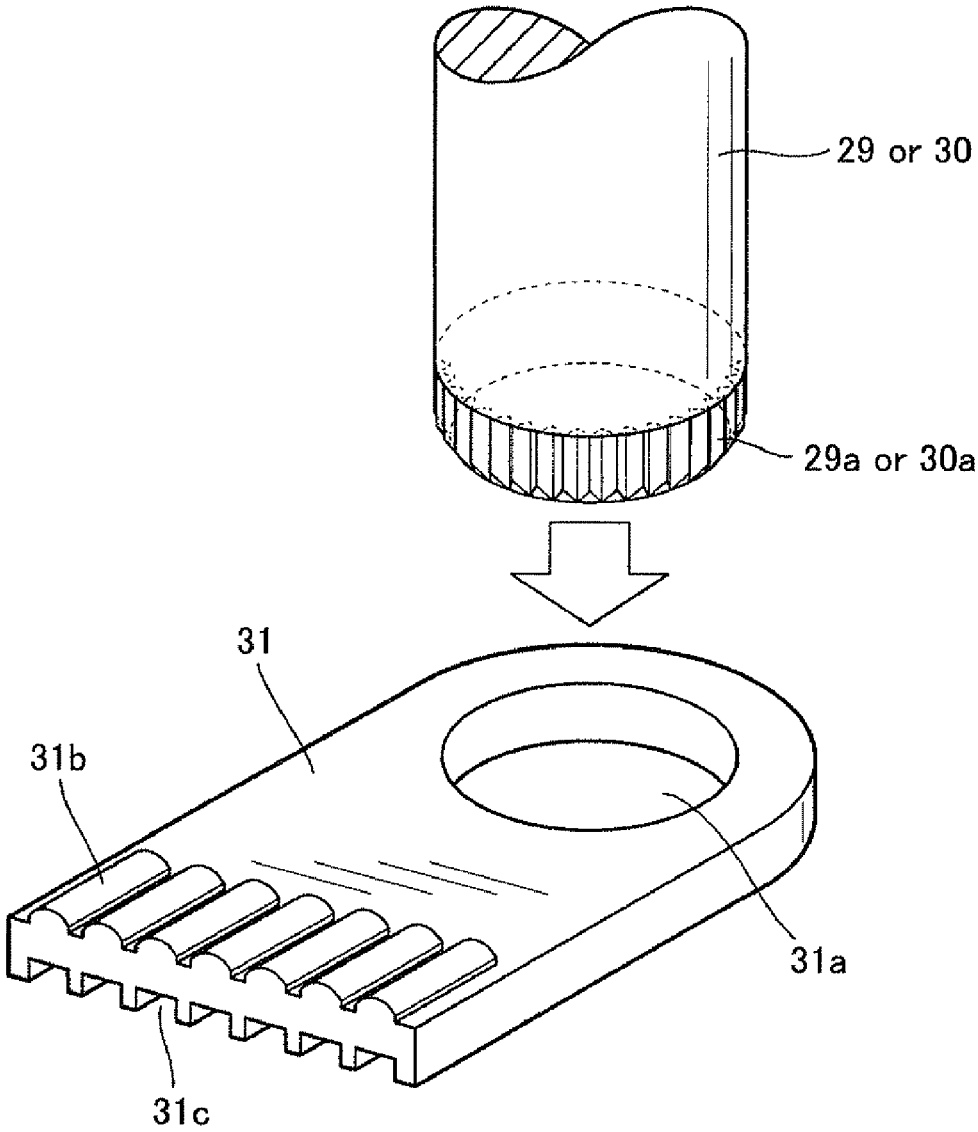
FIG. 4 shows another perspective view showing the assembling process of the terminal-bolt and the fixed contact.

Alternatively, as shown in FIG. 4, serrations 29*a* and 30*a* may formed in the perimeter sides of the one ends of the terminal-bolts 29 and 30, and serration press fit (the portions in which the serrations 29*a* and 30*a* are formed are pressed fit into the fixing holes 31*a*) to the terminal-bolts 29 and 30 for fixing the bolts 29 and 30 to the fixing holes 31*a* formed in the fixed contacts 31 may be performed.

Two terminal-bolts 29 and 30 and the set of fixed contacts 31 are formed with different kinds of metals. For example, the two terminal-bolts 29 and 30 are made iron and the set of fixed contacts 31 are made of copper. The two terminal-bolts 29 and can also be copper plated. The bolts 29 and 30 are manufactured by thread rolling.

Figure 5A:
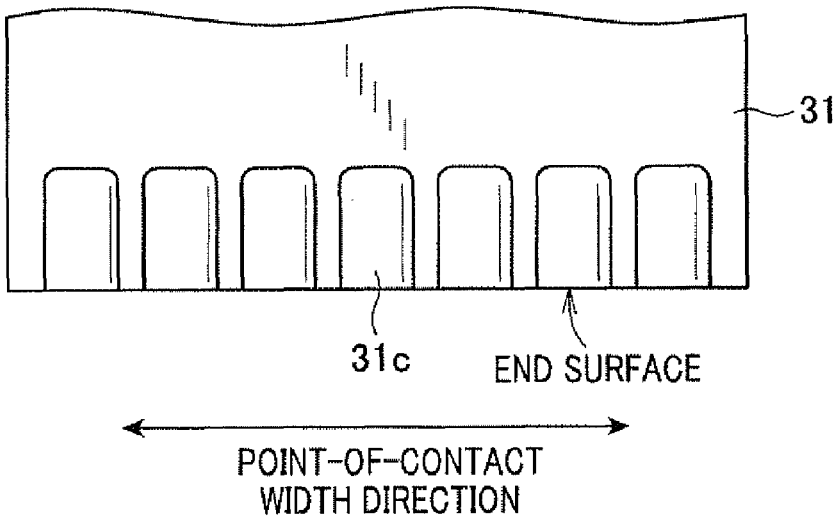
FIG. 5A shows a plane view of the fixed contact showing a portion in which concavo-convex portions are formed.
Figure 5B:
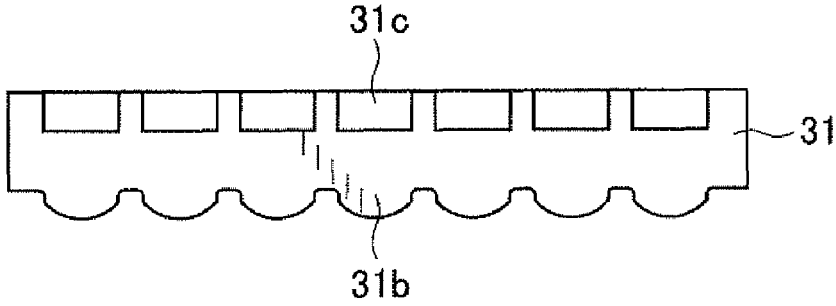
FIG. 5B shows a view that shows the concavo-convex portions and a concavo-convex parts seen from an end surface of the fixed contact.

As shown in FIG. 5B, a plurality of concavo-convex parts 31*b* is provided on a surface of the fixed contact 31 that faces the movable contact 32 (bottom part of the figure). A plurality of concavo-convex portions 31*c* is provided on another surface of the fixed contact 31 that faces an anti movable-contact side.

The concavo-convex portions 31*c* are arranged so that positions of concave parts of the concavo-convex portions 31*c* match positions of convex parts of the concavo-convex portions 31*c* provided in the opposite surface of the fixed contact 31.

The plurality of concavo-convex parts 31*b* are at least partly curved, and have the same height and project in a height direction from the fixed contact 31. The plurality of concavo-convex portions 31*c* is formed as a series of depressions.

Pressing can form above-mentioned concavo-convex parts 31*b* and concavo-convex portions 31*c*. That is, by performing press processing to the plate-like fixed contact 31 with the upper die (not shown) that provides a convex part corresponding to the form of concavo-convex portions 31*c*, and the lower die (not shown) that provides concave part corresponding to the form of concavo-convex parts 31*b*, the concavo-convex portions 31*c* are formed on the surface of the opposite side of the fixed contact 31, while the concavo-convex parts 31*b* project on the surface of the one side of the fixed contact 31.

When a direction (vertical direction in FIG. 1) that intersects perpendicularly with the axial direction of the two terminal-bolts 29 and 30 is called the direction-between-point-of-contact, and when a direction that intersects the direction of plate thickness of the fixed contact 31 and intersects perpendicularly with the direction-between-point-of-contact is called a point-of-contact-width-direction (refer to FIG. 3), the concavo-convex parts 31*b* and the concavo-convex portions 31*c* are formed in predetermined length from the end surface (end surface by which both the fixed contacts 31 face each other in the direction-between-point-of-contact) of the fixed contact 31 along the direction-between-point-of-contact, as shown in FIG. 5A, and formed in parallel with a fixed interval therebetween in the point-of-contact-width-direction (horizontal direction in FIG. 1).

The movable contact 32 is arranged at the anti-movable core side (right-hand side of FIG. 1) from the set of fixed contacts 31, and is forced on the end surface of a rod 39 made of resin fixed to the movable core 27 in response to the load of a contact pressure spring 40.

However, since the initial load of the return spring 36 is set greater than the initial load of the contact pressure spring 40, the movable contact 32 is seated on an internal seat surface 28*b* (refer to FIG. 1) of the resin cover 28, where the contact pressure spring 40 is pushed and contracted, when the switch coil 25 is not energized.

A motor point-of-contact is dosed when between both the fixed contacts 31 is connected by the movable contact 32 being energized by the contact pressure spring 40 and contacts with the set of fixed contacts 31 by sufficient thrust. The motor point-of-contact is opened when electrical connection between both the fixed contacts 31 is broken by the movable contact 32 being separated from the set of fixed contacts 31.

Next, operation of the starter 1 is explained.

When performing the usual engine starting, the user turns on an IG key (ignition key, not shown) and starts the engine in the state where the engine has stopped completely.

The ECU 21 turns on the starter relay 20 in response to an engine-starting signal generated by turning on the IG key.

Thereby, the battery 6 energizes the solenoid coil 14 of the solenoid 5 for pushing out the pinion, and the magnetized fixed iron core 16 attracts the plunger 17, then the plunger 17 moves.

With the movement of the plunger 17, the pinion movable body is pushed out in the anti-motor side via the shift lever 4 and the end surface of the pinion 13 stops in contact with the end surface of the ring gear 24.

After a predetermined time, an ON signal is outputted from the ECU 21 from generating of the engine-starting signal to the switch coil 25 of the switch 7.

By this, the switch coil 25 is energized and the movable core 27 is attracted into the fixed iron core 16, and the motor point-of-contact closes by the movable contact 32 being pressed by the contact pressure spring 44 in contact with the set of fixed contacts 31.

Consequently, the motor 2 is energized and torque occurs in the armature 10, the torque is then transmitted to the output shaft 3, and rotation of the output shaft 3 is further transmitted to the pinion 13 via the clutch 12.

When the pinion 13 rotates to the position engageable to the ring gear 24, the pinion 13 engages to the ring gear 24 by the counterforce stored in the drive spring, and torque is transmitted to the ring gear 24 from the pinion 13 and the engine is started.

Although the above-mentioned operation is an explanation at the time of the usual engine starting by ON operation of the IG key (called the key starting time), the starter 1 of the present embodiment can be used suitably not only in response to use of the IG key, but when a re-starting demand occurs in the process that an idle stop is operated and the engine is stopped (called the re-starting time), since the starter 1 can control independently the operation of the solenoid 5 for pinion extrusion and the switch 7 for motor energization by ECU 21 separately.

For example, when the re-starting demand occurs in the process that the engine stops, ECU 21 controls the operation of the solenoid 5 for pinion extrusion and the switch 7 for motor energization based on the number-of-rotations information taken in from a rotation detector 41 (refer to FIG. 6) that detects the number of rotations of the engine or the ring gear 24.

Specifically, when the number of rotations detected by the rotation detector 41 is lower than the predetermined number of rotations (for example, number of rotations at idling), the solenoid 5 for pinion extrusion is operated before the switch 7 for motor energization is operated, and the switch 7 for motor energization is operated and the motor 2 is started after the pinion 13 meshes with the rotating ring gear 24.

Thereby, the torque of the motor 2 is transmitted to the ring gear 24 from the pinion 13, and can re-start the engine.

On the other hand, when the number of rotations detected by the rotation detector 41 is higher than the predetermined number of rotations, the switch 7 for motor energization is operated before the solenoid 5 for pinion extrusion, and when the relative number of rotations of the ring gear 24 and the pinion 13 reach the predetermined value, the solenoid 5 for pinion extrusion may be operated.

The relative number of rotations of the ring gear 24 and the pinion 13 can be judged by ECU 21 based on the logic set up beforehand from the number of rotations of the engine or the ring gear 24 detected by the number-of-rotations detector 41, and the predicted ascending curve (start up profile of time/rotation speed curve of the motor 2) of the number of rotations of the motor.

[Effect of the First Embodiment]

The switch 7 for motor energization with which the electromagnetic relay of the present invention is applied can simplify the manufacturing process as compared with the joining process such as welding etc., and can improve the assembling process sharply, since the terminal-bolts 29 and 30 and the fixed contact 31 can be assembled and fixed mechanically by press fitting one end of the terminal-bolts 29 (and 30) in the fixing hole 31*a* formed in the fixed contact 31.

In addition, as shown in FIG. 4, when forming the serrations 29*a* and 30*a* in the perimeter side of the terminal-bolts 29 and 30, and then serration press fitting the terminal-bolts 29 and 30 into the fixing hole 31*a* of the fixed contact 31, the process can be managed more easily and the components can be fixed more firmly in comparison with the case where the serrations are not provided.

The switch 7 for motor energization has a structure where the movable contact 32 is energized by the contact pressure spring 40, and contacts the fixed contact 31 when the electromagnet is formed by the energization to the switch coil 25 and the fixed iron core 16 is attracted in the movable core 27.

Although the direction where the movable contact 32 contacts the fixed contact 31 is the anti-press fit direction (left in FIG. 1) of the fixed contact 31 to the terminal-bolts 29 and 30 at this time, since the energization power of the contact pressure spring 40 is small, in case the movable contact 32 contacts the fixed contact 31, the fixed contact 31 does not escape from the terminal-bolts 29 and 30.

The plurality of concavo-convex parts 31*b* is provided on the one surface of the fixed contact 31 that faces the movable contact 32. Each of the concavo-convex parts 31*b* are at least partly curved, and have the same height and project in a height direction from the fixed contact 31.

On the surface of the opposite side of the fixed contact 31 that is the anti movable-contact side, the concavo-convex portions 31*c* are provided in the position corresponding to the plurality of the concavo-convex parts 31*b*.

The concavo-convex parts 31*b* and the concavo-convex portions 31*c* are formed in predetermined length from the end surface of the fixed contact 31 along the direction-between-point-of-contact, and formed in parallel with a fixed interval therebetween in the point-of-contact-width-direction.

The "predetermined length" may be approximately the same length with the length of the movable contact 32 and the fixed contacts 31 that overlap in the direction of the points-of-contact, or longer when the movable contact 32 contacts the fixed contacts 31.

According to the above-mentioned composition, the loose connection of the movable contact 32 and both the fixed contacts 31 can be prevented because of the firm contact of the movable contact 32 and both the fixed contacts 31, since the tip of the concavo-convex parts 31*b* provided on the fixed contact 31 can line-contact the surface of the movable contact 32 when the movable contact 32 contacts the fixed contact 31.

Since a fixed contact 31 does not need to be formed into the concavo-convex parts 31*b* by forging and can form it easily by pressing by using copper plate material, the equipment of a large-scale cold forging machine is unnecessary, and it is easy to manufacture.

When the starter disclosed in this embodiment is equipped in the vehicles provided with the idle stop system that stops engines at the time of the vehicles are stopped, for example, the number of times of starting the engines increases sharply.

Therefore, the number of times of energization to the fixed contact 31 may increase, and the temperature of the fixed contact 31 may rise.

In such a case, the heat can be discharged efficiently since the concavo-convex portions 31*c* are formed in the anti movable-contact side of the fixed contact 31.

[Second Embodiment]

Figure 7:
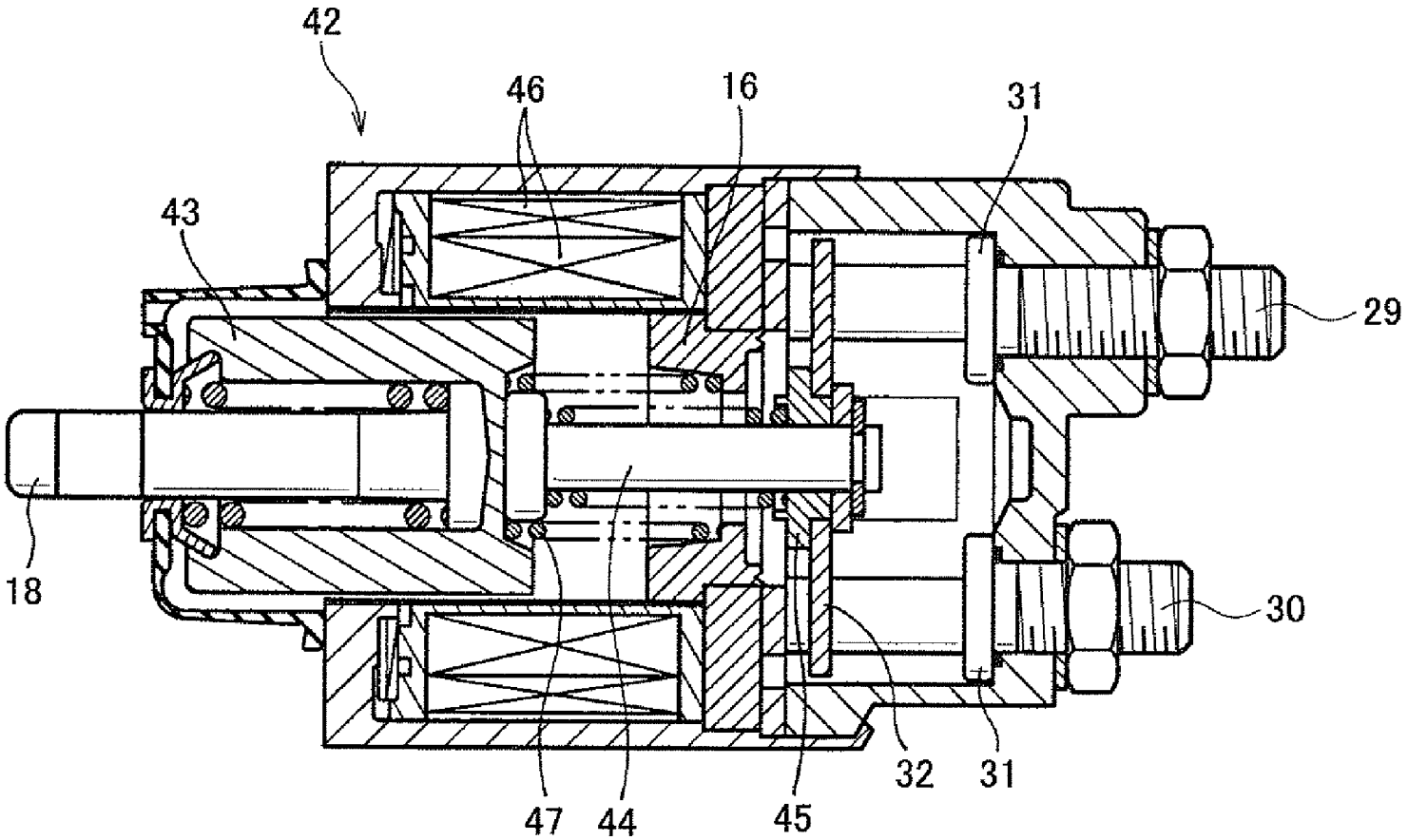
FIG. 7 shows a sectional view of an electromagnetic switch for starters according to a second embodiment.

This second embodiment is an example showing the electromagnetic relay of the present invention applied to a common electromagnetic switch 42 for starters shown in FIG. 7.

As shown in FIG. 7, the electromagnetic switch 42 has a set of fixed contacts 31 provided to two terminal-bolts 29 and 30, and a movable contact 32 that faces and movable to the set of these fixed contacts 31. The movable contact 32 is supported via an insulator 45 at an end of a rod 44 fixed to a plunger 43.

When a fixed iron core 16 is magnetized by the energization to an electromagnetic coil 46, the plunger 43 is attracted to the fixed iron core 16 pushing and contracting a return spring 47 arranged between the fixed iron cores 16 and the plunger 43.

By the movement of the plunger 43, a pinion movable body is pushed out in the axial direction via a gearshift connected to a joint 18, and the movable contact 32 contacts to the set of fixed contacts 31, thus a motor point-of-contact closes.

In the above-mentioned electromagnetic switch 42, the fixed contacts 31 are fixed to the ends of the terminal-bolts 29 and 30 by press fit (or serration press fit) like those of the first embodiment.

A plurality of concavo-convex parts are provided on one surface of the fixed contact 31 that faces the movable contact 32, and concavo-convex portions are formed in the position corresponding to the concavo-convex parts on an opposite surface that is an anti movable-contact side.

The concavo-convex parts and the concavo-convex portions are formed in a straight line along a direction-between-a-point-of-contact, and are formed in parallel with a fixed interval in a point-of-contact-width-direction.

The plurality of concavo-convex parts are at least partly curved, and have the same height and project in a height direction from the fixed contact.

Pressing can easily provide the concavo-convex parts and the concavo-convex portions.

[Third Embodiment]

Figure 8:
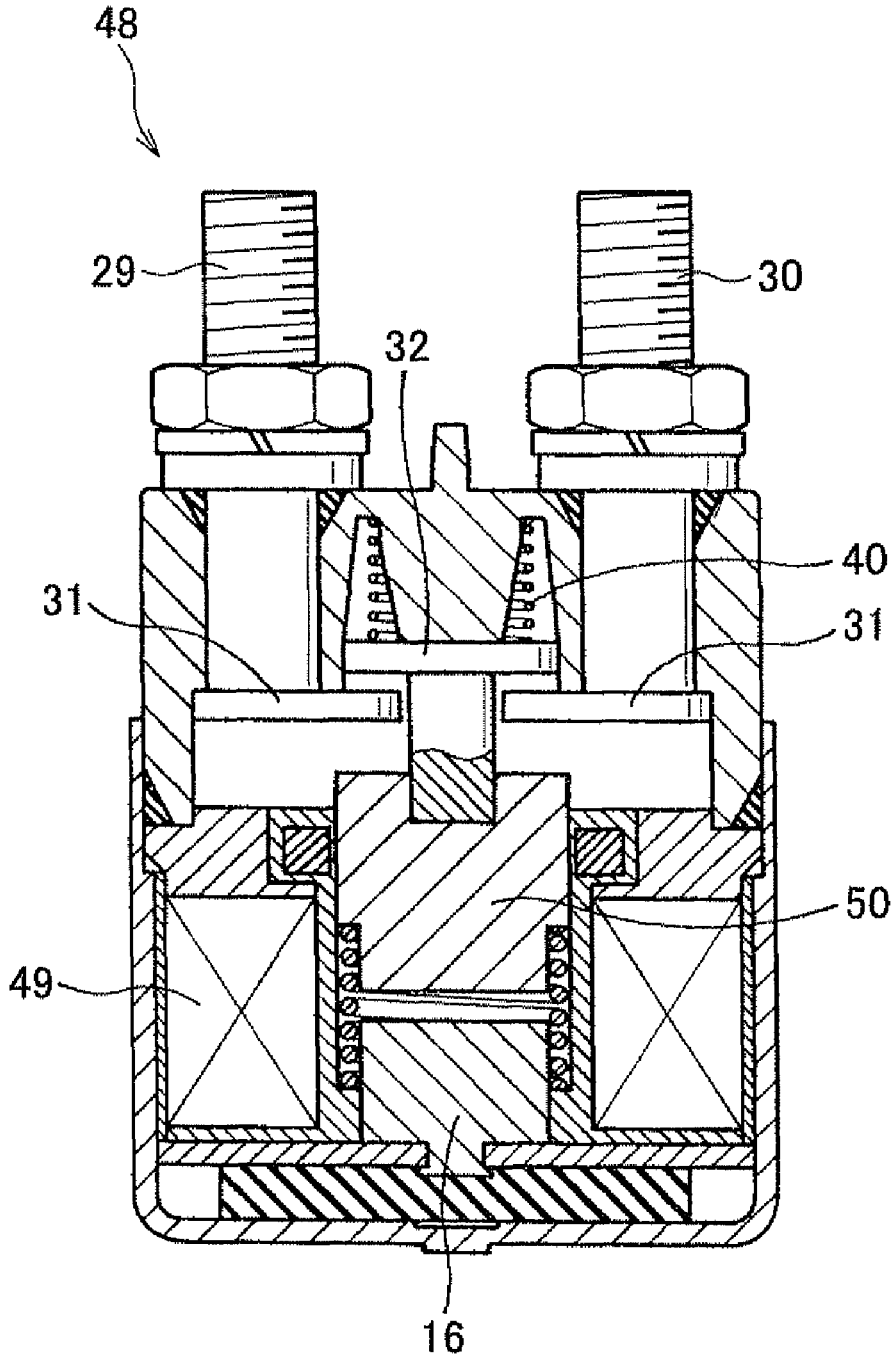
FIG. 8 shows a sectional view of a plunger type relay according to a third embodiment.

As shown in FIG. 8, the third embodiment is an example of the well-known plunger type relay 48, and an operation method is the same with the switch 7 for motor energization disclosed in the first embodiment.

That is, a relay 48 of the present embodiment has a relay coil 49 that generates a magnetic field by energization, a fixed iron core 16 magnetized by the energization to the relay coil 49, and a plunger 50 movable in an axial direction of the relay coil 49 facing the fixed iron core 16.

When the plunger 50 is attracted to the fixed iron core 16 by the attractive force of an electromagnet, the movable contact is energized by a contact pressure spring 40, and contacts a set of fixed contacts 31.

In this relay 48, the ends of the terminal-bolts 29 and 30 are press fit (or serration press fit) into fixed holes formed in the fixed contact 31 like the first embodiment, thus both are assembled electrically and mechanically.

A plurality of concavo-convex parts is provided on a surface of the fixed contact 31 that faces the movable contact 32. A plurality of concavo-convex portions is provided on another surface of the fixed contact 31 that faces an anti movable-contact side.

The concavo-convex portions are arranged so that positions of concave parts of the concavo-convex portions match positions of convex parts of the concavo-convex portions provided in the opposite surface of the fixed contact 31.

Pressing can easily provide the concavo-convex parts and the concavo-convex portions to the plate-like fixed contact 31.

What is claimed is:

1. An electromagnetic relay for starters comprising:

a first terminal-bolt that is connected to a power supply side of an electric circuit;

a second terminal-bolt connected to a load side of the electric circuit;

a set of fixed contacts fixed on one end of each of the first and second terminal-bolts;

a movable contact that faces and is movable to the set of fixed contacts; and a solenoid that drives a movable core by forming an electromagnet by energization; wherein, the movable contact that is synchronized with a movement of the movable core electrically intermits the set of fixed contacts, the first and second terminal-bolts and the set of fixed contacts are formed with different kinds of metals, a plurality of concavo-convex parts is provided on a surface of the fixed contact that faces the movable contact, a plurality of concavo-convex portions is provided on another surface of the fixed contact that faces an anti movable-contact side, the concavo-convex portions are arranged so that positions of concave parts of the concavo-convex portions match positions of convex parts of the concavo-convex parts provided in the opposite surface of the fixed contact, the plurality of concavo-convex parts are at least partly curved, and have the same height and project in a height direction from the fixed contact.

2. The electromagnetic relay for starters of claim 1, wherein, when a direction that is perpendicular to the axial direction of the first and second terminal-bolts is called the direction-between-point-of-contact, and when a direction that intersects the direction of plate thickness of the fixed contact and intersects perpendicularly with the direction-between-point-of-contact is called a point-of-contact-width-direction, the concavo-convex parts and the concavo-convex portions are formed in predetermined length from the end surface of the fixed contact along the direction-between-point-of-contact, and the concavo-convex parts and the concavo-convex portions are formed in parallel with a fixed interval therebetween in the point-of-contact-width-direction.

3. The electromagnetic relay for starters of claim 1, wherein, the concavo-convex parts and the concavo-convex portions are formed by pressing.

4. The electromagnetic relay for starters of claim 1, wherein, a fixing hole is formed on to the fixed contact that penetrates in a direction of plate thickness, and each one end of the first and second terminal-bolts is pressed fit into the fixing hole.

5. The electromagnetic relay for starters of claim 4, wherein, serrations are formed in the perimeter sides of the one ends of the first and second terminal-bolts, and the first and second terminal-bolts are serration press fit to the fixing holes formed in the fixed contacts.

6. The electromagnetic relay for starters of claim 1, wherein, the electromagnetic relay is used for a switch for motor energization that switches on/off a current that flows from battery to a starter motor for starting engines.

* * * * *